US005413122A

United States Patent [19]

Shu et al.

[11] Patent Number: 5,413,122

[45] Date of Patent: May 9, 1995

[54] METHOD OF PROVIDING FLAVORFUL AND AROMATIC COMPOUNDS

[75] Inventors: Chi-Kuen Shu, Pfafftown; Brian M. Lawrence, Winston-Salem, both of N.C.

[73] Assignee: R. J. Reynolds Tobacco Company, Winston-Salem, N.C.

[21] Appl. No.: 837,844

[22] Filed: Feb. 18, 1992

[51] Int. Cl.[6] ..... A24B 15/00

[52] U.S. Cl. ..... 131/274; 131/275; 131/278; 544/336; 544/408

[58] Field of Search ..... 131/274, 275, 278; 544/336, 408

[56] References Cited

U.S. PATENT DOCUMENTS

| | | | |
|---|---|---|---|
| 3,095,882 | 7/1963 | Hind et al. . | |
| 3,136,321 | 6/1964 | Davis . | |
| 3,316,919 | 5/1967 | Green . | |
| 3,424,171 | 1/1969 | Rooker . | |
| 3,478,015 | 11/1969 | Onishi et al. . | |
| 3,782,973 | 1/1974 | Pittet et al. | 131/278 |
| 4,150,677 | 4/1979 | Osborne, Jr. et al. . | |
| 4,281,671 | 8/1981 | Bynre et al. . | |
| 4,306,577 | 12/1981 | Wu et al. . | |
| 4,421,126 | 12/1983 | Gellatly . | |
| 4,506,682 | 3/1985 | Muller . | |
| 4,537,204 | 8/1985 | Gaisch et al. . | |
| 4,605,016 | 8/1986 | Soga et al. . | |
| 4,638,816 | 1/1987 | Cox et al. . | |
| 4,708,151 | 11/1987 | Shelar . | |
| 4,714,082 | 12/1987 | Banerjee et al. . | |
| 4,744,375 | 5/1988 | Denier et al. . | |
| 4,756,318 | 7/1988 | Clearman et al. . | |
| 4,771,795 | 9/1988 | White et al. . | |
| 4,788,289 | 11/1988 | Su et al. | 544/336 |
| 4,793,365 | 12/1988 | Sansabaugh, Jr. et al. . | |
| 4,825,884 | 5/1989 | Denier et al. . | |
| 4,862,905 | 9/1989 | Green, Jr. et al. . | |
| 4,895,175 | 1/1990 | Baskevitch et al. . | |
| 5,005,593 | 4/1991 | Fagg . | |
| 5,016,654 | 5/1991 | Bernasek et al. . | |

FOREIGN PATENT DOCUMENTS

| | | |
|---|---|---|
| 212234 | 7/1986 | European Pat. Off. . |
| 277519 | 1/1988 | European Pat. Off. . |
| 326370 | 1/1989 | European Pat. Off. . |
| 338831 | 4/1989 | European Pat. Off. . |
| 342538 | 5/1989 | European Pat. Off. . |

*Primary Examiner*—Paul Prebilic

[57] ABSTRACT

A flavorful and aromatic compound for use in a smoking article is provided by subjecting an amino acid having a hydroxy group to heat treatment at a pressure of about 10 psig to about 1000 psig and at a temperature of at least about 100° C. to provide a reaction material including flavorful and aromatic composition, and collecting the flavorful and aromatic composition for use in altering the aroma of mainstream smoke upon burning of a smoking compound during use.

5 Claims, No Drawings

METHOD OF PROVIDING FLAVORFUL AND AROMATIC COMPOUNDS

BACKGROUND OF THE INVENTION

The present invention relates to smoking articles such as cigarettes, and in particular to processes for providing a flavorful and aromatic composition similar to those characteristics of certain tobaccos.

Popular smoking articles, such as cigarettes, have a substantially rod shaped structure and include a charge of smokable material such as strands or shreds of tobacco (e.g., cut filler) surrounded by a paper wrapper thereby providing a so-called "tobacco rod." Numerous popular cigarettes have cylindrical filter elements aligned in an end-to-end relationship with the tobacco rod. Typically, filter elements are constructed from fibrous materials such as cellulose acetate, have a circumscribing plug wrap, and are attached to the tobacco rod using tipping material.

Many types of smoking products and improved smoking articles have been proposed through the years as improvements upon, or as alternatives to, the popular smoking articles. Recently, U.S. Pat. Nos. 4,708,151 to Shelar; 4,714,082 to Banerjee et al.; 4,756,318 to Clearman et al.; and 4,793,365 to Sensabaugh, Jr. et al.; and European Patent Publication Nos. 212,234 and 277,519 propose cigarettes and pipes which comprise a fuel element, an aerosol generating means physically separate from the fuel element, and a separate mouth-end piece. Such types of smoking articles provide natural tobacco flavors to the smoker thereof by heating, rather than burning, tobacco in various forms.

Flavorful and aromatic compounds are important components of smoking articles and provide improved taste and aroma to the smoking article. Thus improved processes for providing flavor and aromatic substances and flavorable and aromatic forms of tobacco are desirable. For example, various processes for producing and using tobacco extracts, aroma oils and concentrates are proposed in U.S. Pat. Nos. 3,136,321 to Davis; 3,316,919 to Green; 3,424,171 to Rooker; 4,421,126 to Gellatly and 4,506,682 to Mueller and European Patent Publication No. 338,831 to Clapp et al.

It would be highly desirable to provide a method of forming a flavorful and aromatic compound useful in a smoking article and components thereof and when employed provide highly pleasant smelling mainstream smoke and which delivers good tobacco taste to the smoker.

SUMMARY OF THE INVENTION

The present invention relates to a method of providing a flavorful and aromatic composition, and particularly a flavorful and aromatic composition similar to and complimenting those found in smokable materials. In particular, an amino acid having a hydroxy group is subjected to heat treatment at a pressure of about 10 psig to about 1000 psig and at a temperature of at least about 100° C. to provide a reaction material. Normally, the amino acid having a hydroxy group is exposed to a temperature sufficiently high and for a period of time sufficiently long so as to provide a reaction material which does not exhibit a "green" or harsh flavor. However, it is preferable that the reaction material is not exposed to such a high temperature for a sufficiently long period of time so as to provide a reaction material which exhibits a burnt, tarry, overly bitter or highly metallic flavor.

The pressure controlled environment is provided by a pressure chamber or vessel which provides, during heat treatment, containment of the amino acid and sugar mixture such that the lighter active compounds formed (e.g., ammonia, acetaldehyde, carbonyls, etc.) are contained under conditions sufficient to generate the volatile flavor and aromatic composition. The vessel provides for heat treatment at a temperature significantly above 100° C. and at a typical pressure range of from about 10 psig to about 1,000 psig, normally from about 20 psig to about 500 psig.

The resulting flavorful and aromatic composition includes pyrazine and pyridine components which are often components of tobacco-derived flavorful and aromatic compounds. The present flavorful and aromatic composition is useful as casing or top dressing components for tobacco laminae and cut filler, as well as for other smokable materials. Alternatively, such a flavorful and aromatic composition is useful in those types of smoking articles described in U.S. Pat. Nos. 4,708,151 to Shelar; 4,714,082 to Banerjee et al.; 4,756,318 to Clearman et al.; and 4,793,365 to Sensabaugh et al.; as well as European Patent Publication Nos. 212,234 and 277,519.

The flavorful and aromatic compositions also are useful as cigarette filter additives. For example, the flavorful and aromatic compositions can be incorporated into low density polyethylene and formed into strands, and then incorporated into cigarette filters as described in U.S. Pat. Nos. 4,281,671 to Bynre et al. and 4,862,905 to Green, Jr. et al. The flavorful and aromatic compositions also are useful as cigarette wrapper additives; or as additives to the inner regions of cigarette packages (e.g., within a paper/foil laminate of cigarette package or within a low density polyethylene film which is placed within a cigarette package) in order to provide a desirable cigarette aroma and "pack aroma."

DETAILED DESCRIPTION OF THE PREFERRED EMBODIMENTS

An amino acid having a $\beta$hydroxy group is subjected to heat treatment at a pressure of about 10 psig to 1000 psig and at a temperature of at least about 100° C. to provide a reaction material comprising the flavorful and aromatic composition. The amino acids and analogs thereof have the formula:

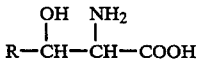

wherein R is H or $C_1$ to $C_7$ and the compound has a hydroxy group at the $\beta$ position. Exemplary amino acids include serine and threonine and analogs thereof.

The amino acid having a hydroxy group is subjected to moderately high temperature treatment. Typically, such treatment involves exposing the amino acid having a hydroxy group to a temperature above about 100° C., preferably above about 110° C., and more preferably above about 120° C. However, it is desirable to subject the amino acid to a temperature below about 250° C., more desirably below about 200° C., in order to avoid an undesirable formation of components which are deleterious to the taste characteristics of the flavorful and aromatic composition. Preferably, a liquid having an aqueous character is contacted with the amino acid prior to heat treatment. Such a liquid consists primarily of water, normally greater than about 90 weight percent water, and can be essentially pure water in certain circumstances. For example, a solvent having an aqueous character can be distilled water, tap water, or the like, preferably a 4:1 to 40:1 ratio of liquid to amino acid is utilized.

The moderately high temperature treatment of the amino acid having a hydroxy group can be performed under an inert atmosphere. For example, nitrogen and argon gas can be employed in order to provide an inert atmosphere. However, the heat treatment can be conducted under ambient atmosphere (i.e., air).

The moderately high temperature treatment is performed in a pressure controlled environment. Such an environment is provided by enclosing the amino acid having a hydroxy group in an air sealed vessel or chamber. Typically, a pressure controlled environment is provided using a pressure vessel or chamber which is capable of withstanding relatively high pressures. Such vessels or chambers (i) provide enclosure or concealment of the amino acid having a hydroxy group such that any volatile flavor components generated are not lost or do not otherwise escape during the moderately high temperature treatment step, and (ii) provide for treatment of the amino acid having a hydroxy group at a temperature significantly above about 100° C. Preferred pressure vessels are equipped with an external heating source. Examples of vessels which provide a pressure controlled environment include a high pressure autoclave from Berghof/America Inc. of Concord, Calif. and a Parr Reactor Model No. 4522 and a Parr Reactor Model No. 4552 available from The Parr Instrument Co. Operation of such exemplary vessels will be apparent to the skilled artisan. Typical pressures experienced by the tobacco composition during the process of the present invention range from about 10 psig to about 1,000 psig, normally from about 20 psig to about 500 psig. Pressures experienced by the amino acid having a hydroxy group typically exceed 100 psig during the process of the present invention.

The amount of time that the amino acid is subjected to the moderately high temperature treatment can vary. Normally, the time period is sufficient to heat the amino acid having a hydroxy group at the desired temperature for a period of at least about 10 minutes, preferably at least about 20 minutes. Normally, the time period is less than about 3 hours, preferably less than about 1 hour. However, it is desirable to control the time/temperature profile of the amino acid subjected to heat treatment so that the amino acid is not subjected to a particularly high temperature for a lengthy period of time. It is highly desirable to employ a pressure vessel design or a vessel equipped with an agitation mechanism such that the amino acid having a hydroxy group experiences a relatively uniform temperature throughout the treatment period. In particular, it is highly desirable for the amino acid to be heated uniformly throughout as much as possible at the maximum temperature to which the amino acid is subjected.

Although wishing not to be bound to any theory, it is believed that the amino acid having a hydroxy group undergoes a reaction to form a hydroxy aldehyde (Strecker aldehyde) without having to undergo Strecker degradation or the Maillard reaction. The hydroxy group of the aldehyde can then be replaced by ammonia which leads to the formation on heating of flavorful pyrazines often found in tobacco-derived flavorful and aromatic compounds. Exemplary pyrazines include pyrazine, methyl pyrazine, ethyl pyrazine, 2,5-dimethyl pyrazine, 2,6-dimethyl pyrazine, 2-ethyl-5-methyl pyrazine, 2-ethyl-6-methyl pyrazine, trimethyl pyrazine, tetramethyl pyrazine, dimethyl ethyl pyrazines, diethyl methyl pyrazines, diethyl dimethyl pyrazines, 6,7-dihydro-5-methyl-5H-cyclopentapyrazine and the like.

The flavorful and aromatic composition can be used with various components of smoking articles. The amount of flavorful and aromatic composition employed per cigarette can vary. For example, in a typical cigarette having about 0.6 to about 1 g/rod of smoking material, about 10 to about 100 ppm of the composition can be used as top dressing or casing.

Cigarettes can further include a filter element such as positioned adjacent to one end of rod such that the filter element is axially aligned with the rod in an end-to-end relation. An exemplary filter element is described in commonly assigned U.S. Ser. No. 07/621,499, filed Dec. 7, 1990, the disclosure of which is incorporated herein by reference. Filter elements have a substantially cylindrical shape, and the diameter of the rod is substantially equal to the diameter of the filter element. Preferably, the filter element abuts the rod. The ends of the filter element are open to permit the passage of air and smoke therethrough. The filter element comprises filter material which optionally is overwrapped with circumscribing wrap material. The filter material can be in intimate contact with the flavorful and aromatic composition. Such a segment is referred to as a "smoke-altering filter segment." Normally, prior to smoking the cigarette, the smoke-altering filter segment includes at least about 0.1 percent of the mixture, based on the weight of the filter material. The filter material can be a conventional cigarette filter material such as cellulose acetate, polypropylene, or the like; and the filter element can have a fibrous character, a molded shape, or other such configuration.

The composition also can be contacted with tobacco and employed as a form of tobacco in smoking article manufacture. For example, tobacco cut filler, as well as the types of smokable materials described in commonly assigned U.S. patent application Ser. No. 276,161, filed Nov. 23, 1988, the disclosure of which is incorporated herein by reference, can be coated or otherwise contacted with about 0.001 to about 1 percent by weight of the flavorful and aromatic composition, based on the weight of the particular smokable material. Furthermore, the coated tobacco cut filler may be combined with aerosol forming materials, and employed in the manufacture of those smoking articles described in U.S. Pat. Nos. 4,708,151 to Shelar; 4,771,795 to White et al.; 4,714,082 to Banerjee et al.; 4,756,318 to Clearman et al.; and 4,793,365 to Sensabaugh et al., the disclosures of which are incorporated herein by reference, as well as European Patent Publication Nos. 212,234 and 277,519. In addition, the coated tobacco cut filler can be incorporated into those smoking articles described in U.S. patent application Ser. No. 414,833 filed Sep. 29, 1989 and European Patent Publication No. 280,990.

When the tobacco rod is burned during use of the smoking article, the flavorful and aromatic composition undergoes a chemical rearrangement to yield compositions or products which exhibit an aroma which can be characterized as pleasant, clean, sweet, floral, woody, musk-like and fruity. The aroma provided by the composition is such that the characteristic sidestream cigarette smoke aroma is masked or overridden by those components. As such, the flavorful and aromatic composition provides for a reduction in the negative attributes associated with the aroma of mainstream smoke.

The following example is provided in order to further illustrate preferred aspects of the invention but should not be construed as limiting the scope thereof. Unless otherwise noted, all parts and percentages are by weight.

Example 1

In a high pressure autoclave available from Berghof-/American Inc. equipped with a temperature control unit available as Parr No. 4842-PID from the Parr Instrument Co., 0.05 moles (5.25 g) of serine in the presence of 50 ml of water was reacted at 200° C. at 200 psig for about 1 hour to form comprising the flavorful and aromatic composition. The flavorful and aromatic composition, as analyzed using a gas chromatograph, was found to include pyrazine, methyl pyrazine, ethyl pyrazine, dimethyl pyrazine, methyl ethyl pyrazine, trimethyl pyrazine, three isomers of dimethyl ethyl pyrazine, tetramethyl pyrazine, two isomers of diethyl dimethyl pyrazine, two isomers of diethyl methyl pyrazine and 6,7-dihydro-5-methyl-5H-cyclopentapyrazine.

Cigarettes have lengths of 84 mm and circumferences of 24.75 mm. Each cigarette has a tobacco rod having a length of 63 mm and a filter element having a length of 21 mm. The tobacco rod includes a charge of tobacco cut filler contained in a circumscribing cigarette paper wrap. The tobacco cut filler has the form of an "American blend", and the paper wrap is available as Reference No. 856 from Kimberly-Clark Corp. The filter element was manufactured using conventional cigarette filter making technology from plasticized cellulose acetate tow circumscribed by paper plug wrap.

The flavorful and aromatic composition is applied to the cut filler of the tobacco rod. In particular, about 20 ppm of the flavorful and aromatic composition is prepared, and applied to the cut filler as a top dressing component of the paper wrap of the tobacco rod. The cigarettes so treated are air dried.

Upon smoking the cigarettes, the resulting cigarette mainstream smoke exhibited a flavor which is more pleasant relative to mainstream smoke of a similar cigarette not having the flavorful and aromatic compounds in intimate contact therewith. The relatively low level of the flavorful and aromatic composition present in the cigarette acts to complement the flavor of the mainstream smoke, and does not provide an overpowering flavor or artificial taste (i.e., undesirable off-taste) to the mainstream cigarette smoke.

That which is claimed is:

1. A method for providing flavorful and aromatic composition for use in a smoking article, the method comprising:

(a) subjecting an amino acid from the group consisting of serine, threonine and analogs thereof in the presence of water to heat treatment at a pressure of about 10 psig to about 1000 psig and at a temperature of at least about 100° C. to provide a flavorful and aromatic composition; and (b) collecting the flavorful and aromatic composition for use in a smoking article.

2. A method according to claim 1 whereby the ratio of water to amino acid is about 4:1 to about 40:1.

3. A method according to claim 1 whereby the pressure during step(a) is from about 20 psig to about 500 psig.

4. A method according to claim 1 whereby the temperature during step (a) is from about 150° C. to about 200° C.

5. A method according to claim 3 whereby the heat treatment is done in an inert atmosphere.

* * * * *